US010539330B2

(12) United States Patent
Buriola et al.

(10) Patent No.: US 10,539,330 B2
(45) Date of Patent: Jan. 21, 2020

(54) KITCHEN UNIT PROVIDED WITH A LIGHTING SYSTEM

(71) Applicant: Electrolux Appliances Aktiebolag, Stockholm (SE)

(72) Inventors: Luigi Buriola, Orsago (IT); Giancarlo Arrigoni, Cassacco (IT); Chiara Ciardetti, Forli (IT); Valerio Verdoliva, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 15/526,143

(22) PCT Filed: Nov. 5, 2015

(86) PCT No.: PCT/EP2015/075819

§ 371 (c)(1),
(2) Date: May 11, 2017

(87) PCT Pub. No.: WO2016/075023

PCT Pub. Date: May 19, 2016

(65) Prior Publication Data

US 2017/0321905 A1 Nov. 9, 2017

(30) Foreign Application Priority Data

Nov. 12, 2014 (EP) ..... 14192814

(51) Int. Cl.
*F24C 15/20* (2006.01)
*H05B 33/08* (2006.01)
*H05B 37/02* (2006.01)

(52) U.S. Cl.
CPC ..... *F24C 15/2064* (2013.01); *H05B 33/0806* (2013.01); *H05B 37/02* (2013.01)

(58) Field of Classification Search
CPC .. F24C 15/2064; H05B 33/0806; H05B 37/02
See application file for complete search history.

(56) References Cited

U.S. PATENT DOCUMENTS

2004/0221839 A1 11/2004 Plankl et al.
2014/0254167 A1* 9/2014 Kennedy ..... F21V 7/041 362/294
2017/0117891 A1* 4/2017 Lohbihler ..... G08C 17/02

FOREIGN PATENT DOCUMENTS

DE 29706787 U1 6/1997
DE 202006016570 U1 2/2008
(Continued)

OTHER PUBLICATIONS

International Search Report dated Feb. 12, 2016 in corresponding International Application No. PCT/EP2015/075819.

*Primary Examiner* — Mary Ellen Bowman
(74) *Attorney, Agent, or Firm* — Pearne & Gordon LLP

(57) ABSTRACT

A kitchen unit (200), for example an extraction hood, has a task lighting system (100) for illuminating an operative area (210) below the kitchen unit. The task lighting system includes: at least a plurality of fixed lighting elements (110) configured to generate, on the operative area, corresponding fixed elementary light spots (270) and macro light spots (280) by the union of the elementary light spots; and a control unit (115) configured to receive a spot position signal indicative of a desired position of a macro light spot and to selectively activate, based on the spot position signal, the lighting elements to generate a macro light spot with said desired position.

21 Claims, 8 Drawing Sheets

(56) References Cited

FOREIGN PATENT DOCUMENTS

| | | | | |
|---|---|---|---|---|
| EP | 2131627 | A1 | 12/2009 | |
| JP | 2009216307 | A | 9/2009 | |
| WO | 03073009 | A1 | 9/2003 | |
| WO | WO 03073009 | A1 * | 9/2003 | ..... F24C 15/2064 |
| WO | 2010146446 | A1 | 12/2010 | |

* cited by examiner

KITCHEN UNIT PROVIDED WITH A LIGHTING SYSTEM

BACKGROUND

The present invention generally relates to the field of lighting systems for kitchen units. More specifically, the present invention relates to a kitchen unit provided with a task lighting system.

Differently from ambient lighting, which is lighting that is simply directed to provide an area with overall illumination, task lighting is lighting which is focused on a specific area to make the completion of visual tasks easier.

Task lighting is a type of lighting which is bright enough to prevent eye strain and is free of distracting glare and shadows. With suitable task lighting, execution of tasks within the illuminated area is greatly eased.

Task lighting may be employed in several fields for different applications.

For example, task lighting may be used in kitchens, to ensure that work spaces are well illuminated so that users are able to clearly see what they are doing, e.g., for allowing them to read recipes while cooking, or ensuring to clean counters properly. A very important application of task lighting used in kitchens relates to the illumination of the cooking hobs.

A number of different lighting systems can be used to create task lighting.

For example, lights on flexible bases or necks may be employed so that they can be manually adjusted as needed. An advantage of task lighting systems of this type is that users are able to easily modify the direction of the emitted light, allowing to focus light in different areas.

Another class of task lighting provides for task lighting systems which are directly mounted in a furniture element or in a home appliance, such as for example a light mounted under a kitchen cabinet for illuminating a kitchen counter or a light mounted under an extractor hood for illuminating a cooking hob located under the latter. Since this type of task lighting system lacks of protruding elements, it is more compact, and less prone to get dirty.

US 2004/0221839 discloses a lighting device for an extractor hood that includes a light source having at least a plurality of controlled LEDs and an extractor hood control device. The light source is connected to the control device. The light source can also include halogen and/or incandescent lamps. The control device can vary a luminous intensity of at least some of the LEDs and/or the lamps, alter a diode current of at least some of the LEDs and/or the lamps, alter a diode current of at least some of the LEDs, and/or drive a subset of the LEDs or lamps.

WO 2010/146446 discloses a lighting apparatus which comprises a head with a light source directed in a light beam and a motorized kinematic structure for spatially directing the head. An image sensor is arranged in the head and it is directed in the direction of the light beam. Electronic processing means process the images taken by the image sensor to distinguish at least one hand of a user inserted into the beam, to distinguish a gesture therein from among a predetermined series of preset gestures in the control system and control a corresponding interactive behavior of the light source. Further distance sensors and sensors for identifying the position of acoustic sources are provided for further additional interactive behaviors of the apparatus.

The Applicant has found that the task lighting systems known in the art are affected by drawbacks.

Indeed, since task lighting systems with lights installed on flexible bases or necks are provided with protruding elements, such type of adjustable lighting system occupies a non-negligible amount of space, and is more prone to get dirty, especially if installed in a kitchen environment.

Moreover, with task lighting systems directly mounted in a furniture element or in a home appliance it is more difficult to adjust the direction of the emitted light, since the light source devices are recessed inside such furniture element or in such a home appliance.

The illumination apparatus disclosed in US 2004/0221839 is configured to set the illumination level for the light source between a maximum illumination level and a state in which the illumination apparatus is switched off, but it is not configured to adjust the direction of the emitted light to focus light in different areas.

The solution disclosed in WO 2010/146446 is quite expensive and complicated, since it requires a motorized kinematic structure to orient the light source.

In view of the above, the Applicant has handled the problem of providing a task lighting system which allows to adjust the direction of the emitted light and at the same time which is neither too expensive nor too complicated.

SUMMARY OF SELECTED INVENTIVE ASPECTS

The present invention thus relates to a kitchen unit having a task lighting system for illuminating an operative area, the task lighting system comprising:

- at least a plurality of fixed lighting elements configured to generate, on the operative area, corresponding fixed elementary light spots and macro light spots by the union of the elementary light spots, and
- a control unit configured to receive a spot position signal indicative of a desired position of a macro light spot and to selectively activate, based on the spot position signal, the lighting elements to generate a macro light spot with said desired position.

The control unit is preferably further configured to receive a spot shape signal indicative of a desired shape of a macro light spot and to selectively activate, based on the spot shape signal, the lighting elements to generate a macro light spot with said desired shape.

The control unit is preferably further configured to receive a spot size signal indicative of a desired size of a macro light spot and to selectively activate, based on the spot size signal, the lighting elements to generate a macro light spot with said desired size.

The task lighting system preferably includes also an input interface configured to receive commands from a user and to generate corresponding signals for the control unit including at least said spot position signal.

The control unit may also be configured to set light features of a macro light spot by setting light features of the activated lighting elements.

Said light features of the macro light spot may comprise at least one among brightness, color, and white color temperature and said light features of the activated lighting elements may comprise at least one among intensity, color, and white color temperature.

Preferably, the control unit comprises a plurality of drivers configured to selectively enable/disable electric power delivery to corresponding lighting elements or groups of lighting elements to selectively activate/deactivate lighting elements or groups of lighting elements.

Such drivers may be further configured to regulate the amount of electric power delivered to the corresponding lighting elements or groups of lighting elements to regulate the intensity of the light emitted by the lighting elements.

In a preferred embodiment of the present invention, each lighting element comprises at least an electric light source and an optical element. Preferably, the electric light source comprises one or more LEDs or one or more lamps, and the optical element comprises one or more lens or mirrors.

The lighting elements of a plurality are preferably arranged according to a matrix.

The task lighting system preferably comprises at least two lighting units each comprising a plurality of lighting elements, wherein the lighting units are positioned on different parts of the kitchen unit to illuminate adjacent portions of the operative area.

The kitchen unit of the present invention is preferably kitchen air extractor hood and wherein the operative area is an area under the extractor hood.

The present invention also relates to a method for illuminating an operative area below a kitchen unit, the kitchen unit being provided with at least a plurality of fixed lighting elements configured to generate, on the operative area, corresponding fixed elementary light spots and macro light spots by the union of the elementary light spots, the method comprising the step of selectively activating, based on a spot position command indicative of a desired position of a macro light spot, the lighting elements to generate a macro light spot with said desired position.

The method may further comprise the step of selectively activating, based on a spot shape command indicative of a desired shape of a macro light spot and/or a spot size command indicative of a desired size of a macro light spot, the lighting elements to generate a macro light spot with said desired shape and/or size.

DETAILED DESCRIPTION OF EXAMPLE EMBODIMENTS

Figure 1:
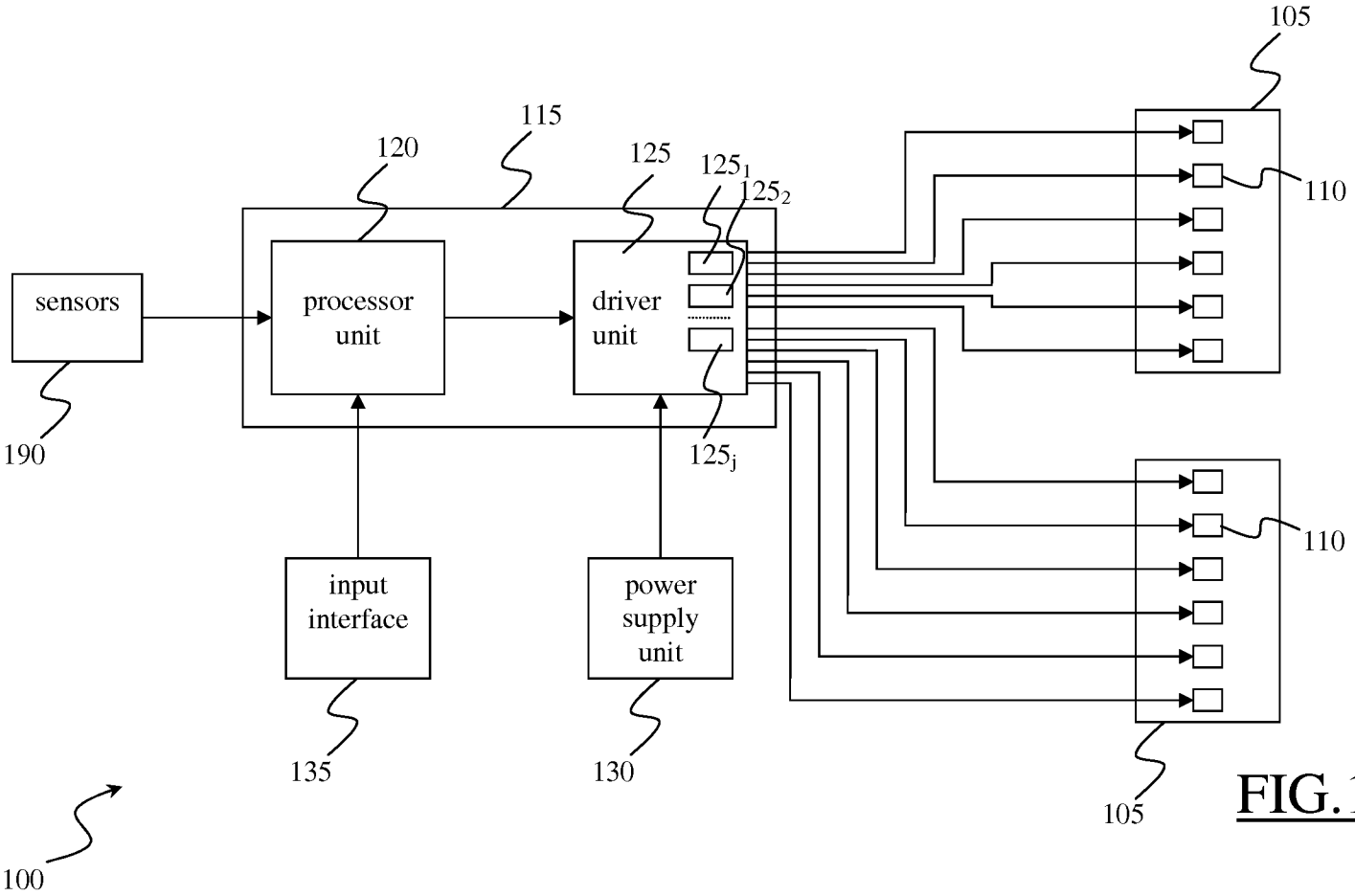
FIG. 1 illustrates in terms of schematic functional blocks a task lighting system according to an embodiment of the present invention.

Making reference to the drawings, FIG. 1 illustrates in terms of schematic functional blocks a task lighting system 100 according to an embodiment of the present invention.

The task lighting system 100 comprises one or more lighting units 105 each one comprising a plurality of lighting elements 110; each lighting element 110 is configured to emit light when activated.

The task lighting system 100 further comprises a control unit 115 configured to control the lighting elements 110. For example, the control unit 115 may comprise a processor unit 120 provided with processing capabilities, for example a microcontroller or a microprocessor, and a driver unit 125 for regulating the electric power to be fed to the lighting elements 110 of the lighting units 105. For example, the driver unit 125 may be configured to regulate the electric power to be fed to the lighting elements 110 by modifying an electric current delivered to the lighting elements 110, such as by regulating the instantaneous value of such current, or by regulating the average value thereof, in case the current is modulated, for example with a Pulse Width Modulation (PWM).

Advantageously, the control unit 115 is electrically supplied by a power supply unit 130, preferably coupled with the mains.

A user can interact with the task lighting system 100 by providing commands to the control unit 115 through an input interface 135 coupled with the latter. In response to the user's commands, the input interface 135 generates corresponding input signals and sends them to the control unit 115.

According to an embodiment of the present invention, the driver unit 125 is configured to deliver electric power to each lighting element 110 individually or to groups of lighting elements 110 (each one comprising more than one lighting element 110), in such a way to activate said lighting elements 110 individually or in group of lighting elements 110. For this purpose, according to an embodiment of the present invention, the driver unit 125 comprises a plurality of drivers $\mathbf{125}_j$ individually controllable by the processor unit 120. Each driver is configured to selectively enable/disable the delivering of electric power provided by the power supply unit 130 to each lighting element 110 individually or to groups of lighting elements 110 (each one comprising more than one lighting element 110).

The task lighting system 100 is suitable to be installed in proximity to an area for the illumination thereof, in such a way that each lighting element 110, when activated, is adapted to emit light for providing a corresponding elementary light spot on said area.

Figure 2A:
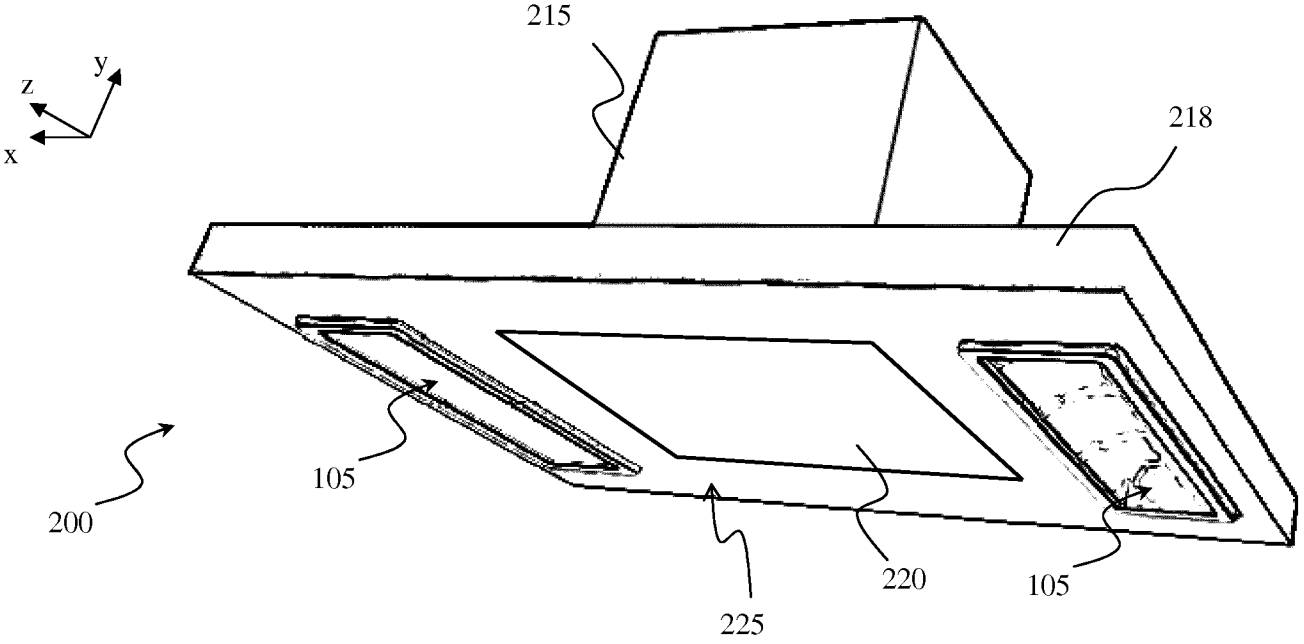
FIG. 2A is a three dimensional view from below of an extractor hood wherein the task lighting system of FIG. 1 may be installed.
Figure 2B:
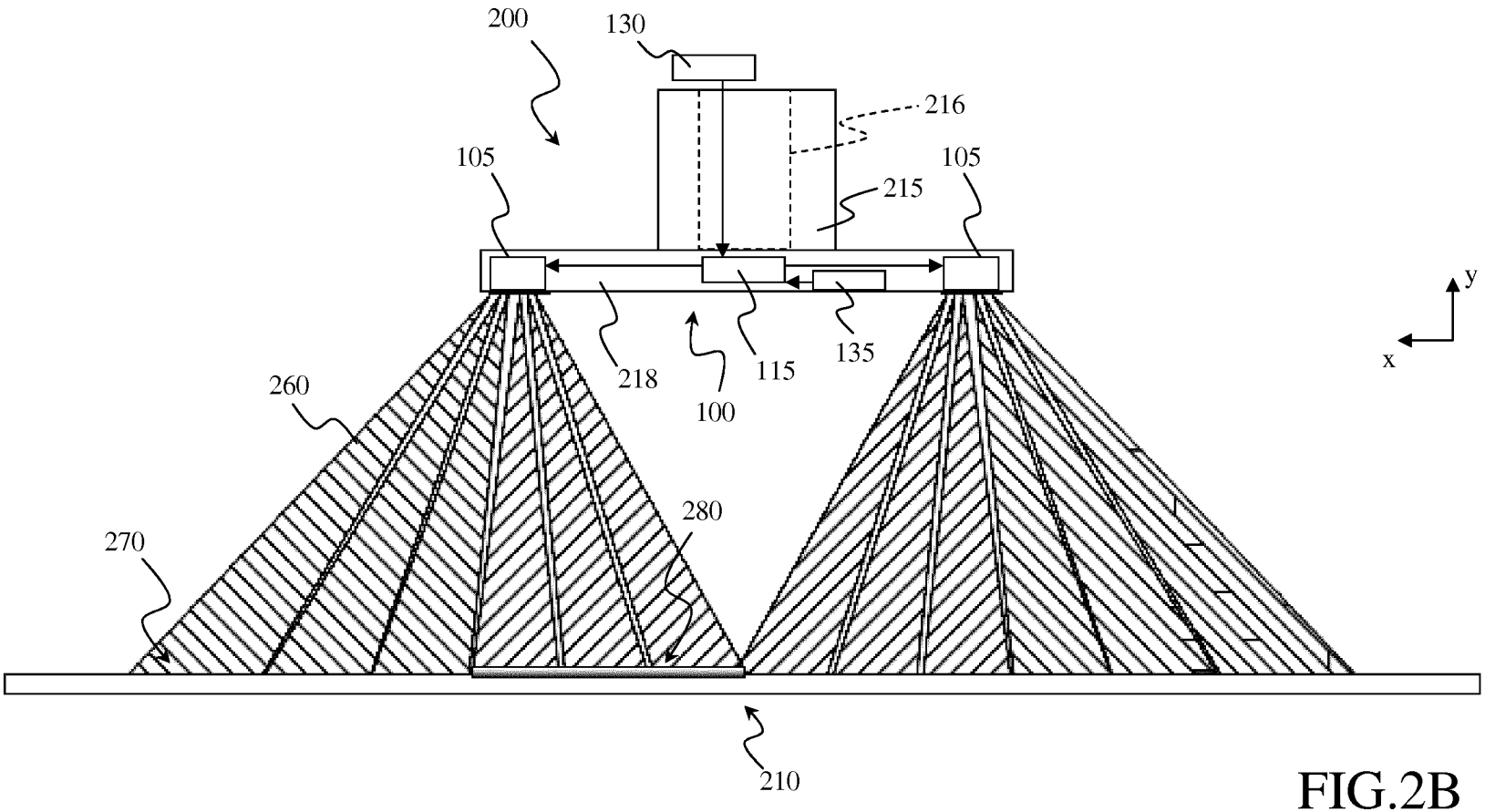
FIG. 2B is a frontal plan view of the extractor hood of FIG. 2A with the task lighting system of FIG. 1 installed thereon.
Figure 2E:
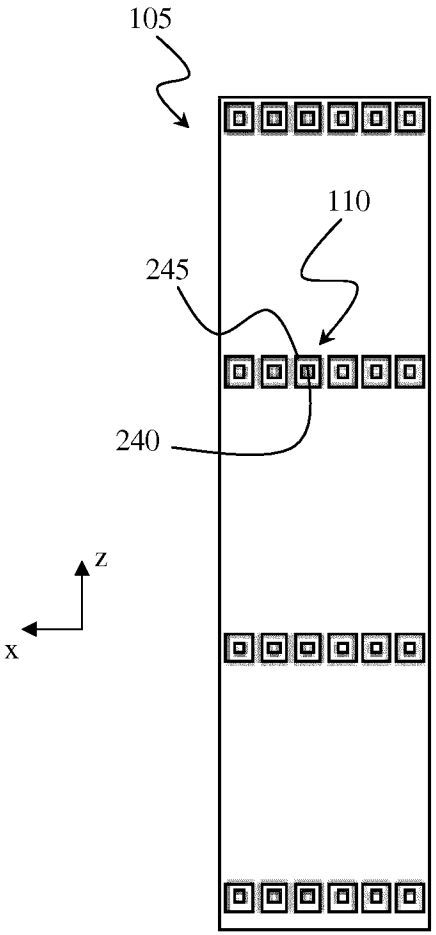
FIG. 2E is a plan view from below of a lighting unit of the task lighting system of FIG. 1.
Figure 2C:
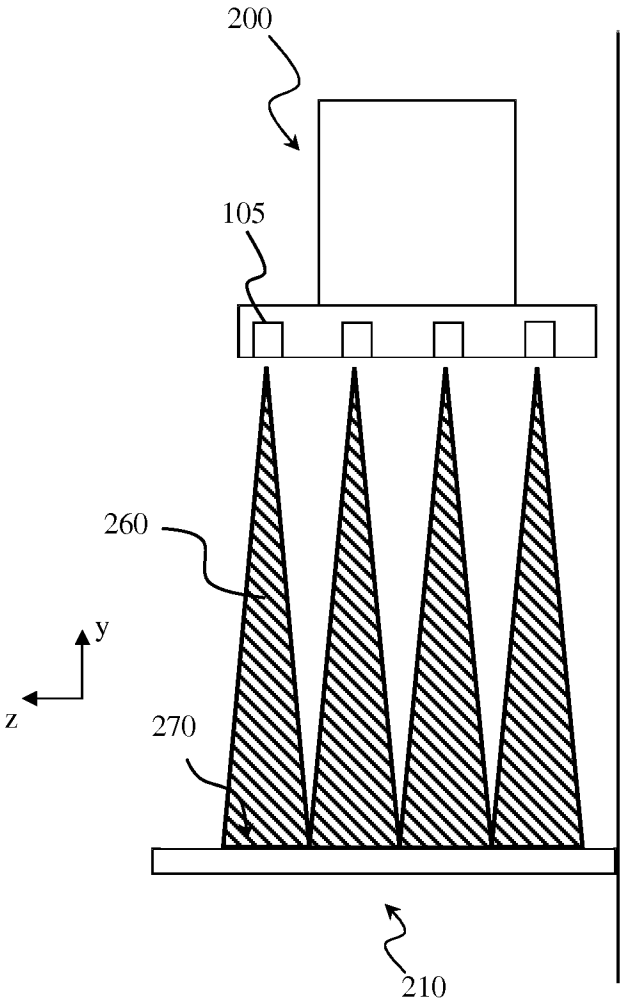
FIG. 2C is a side plan view of the extractor hood of FIG. 2A with the task lighting system of FIG. 1 installed thereon.
Figure 2D:
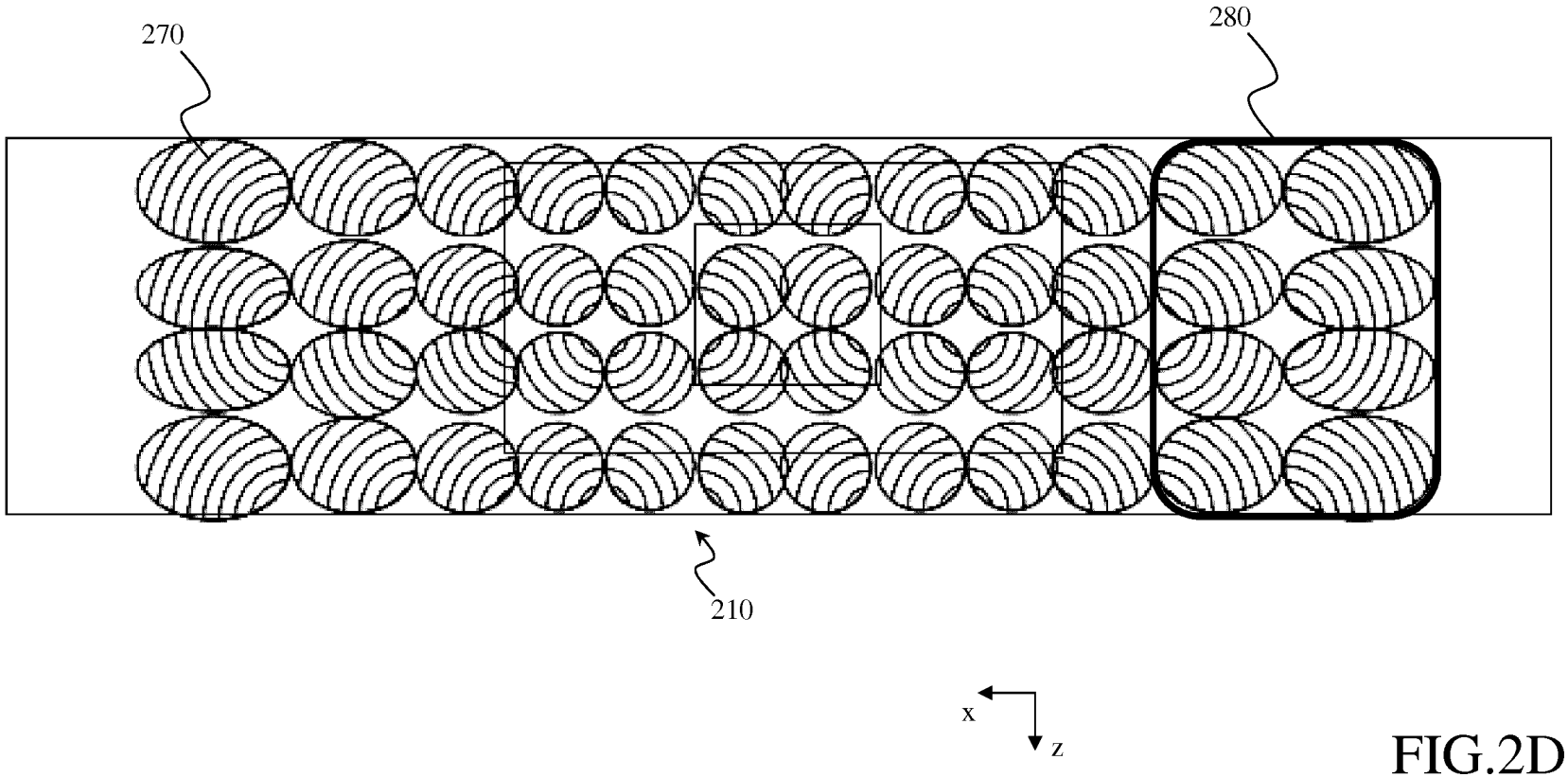
FIG. 2D is a top plan view of an area below the extractor hood of FIG. 2A when illuminated through the task lighting system of FIG. 1.

FIGS. 2A-2D depict an example of how the task lighting system 100 according to an embodiment of the present invention may be installed on an extractor hood 200 for illuminating an area 210 below the extractor hood 200 itself (e.g., wherein the cooking hob is located). FIG. 2A is a three dimensional view from below of the extractor hood 200. FIGS. 2B-2C are a frontal plan view (parallel to the directions y and x) and a side plan view (parallel to the directions z and y), respectively, which schematically illustrate the extractor hood 200, the area 210 and components of the task lighting system 100 according to an embodiment of the present invention. FIG. 2D is a top plan view (parallel to the directions x and z) of the area 210. Even though the elementary light spots 270 have been represented (in FIG. 2D as in the other figures) as having corresponding well defined circular or elliptical borders not intersecting with each other on the area 210 (in particular, the border of each light spot is illustrated as tangential with those of the adjacent light spots), it is evident that these borders are to be intended as imaginary borders indicative of an ideal spot size. According to the real shape of the light beam, which could be, just for example, Gaussian, there will be a part of the beam external to the elliptical borders indicated in FIG. 2D, so that in reality the external portions of the light spots 270 overlap with each other and the illuminated part of the area 210 has a substantially uniform brilliance.

In the illustrated example, the extractor hood 200, which is suitable to remove airborne greases, combustion products, fumes, smoke, heat and steam from the cooking environment, has an upside down T-shape and comprises an upper vertical portion 215 and a lower horizontal portion 218. The upper vertical portion 215 comprises a tubular body defining an internal air passage 216 extending vertically up to an exhaust port (not shown), and a fan (not illustrated) housed in the tubular body. The lower horizontal portion 218 has a substantially flat bottom face 225 and, in the center of the bottom face 225, a sucking port 220 in communication with the internal passage 216.

In the example at issue, the task lighting system 100 comprises two lighting units 105 facing the area 210, located on the bottom face 225 of the horizontal portion 218 at opposite sides of the sucking port 220. FIG. 2E is a plan view from below (parallel to the directions x and z) of one of said two lighting units 105. Naturally, similar considerations apply with a different number of lighting units 105 (e.g., only a single lighting unit 105), and/or with the lighting units 105 positioned at different locations of the extractor hood 200.

According to an embodiment of the present invention, each lighting unit 105 comprises a plurality of lighting elements 110 arranged according to a matrix arrangement. In the example illustrated in FIGS. 2A-2E, each lighting unit 105 comprises 24 lighting elements 110 arranged in four parallel rows each one comprising six lighting elements 110. The concepts of the present invention can be applied to any possible matrix arrangement comprising n rows and m columns of lighting elements 110 (with n or m that may be also equal to one), or to other arrangements different from a matrix arrangement (such as for example a circular arrangement).

According to an embodiment of the present invention, each lighting element 110 comprises an electric light source 240, in turn comprising for example one or more Light-Emitting Diodes (LED) or one or more lamps (e.g., incandescent light bulbs, arc lamps, or gas discharge lamps), and one or more optical elements 245 (e.g., lens or mirrors).

According to an embodiment of the present invention, once the lighting units 105 are installed, so that the reciprocal distance, position and orientation between each lighting element 110 and the area 210 is fixed, the specific arrangement of the lighting elements 110 of each lighting unit 105, the distance, position and orientation of each lighting element 110 with respect to the area 210 to be illuminated, as well as the type of electric light source 240 and optical element 245 of each lighting element 110, and the reciprocal distance, position and orientation between such electric light source 240 and optical element 245 of each lighting element 110 are such that each lighting element 110 emits, when activated, a beam light 260 projecting an elementary light spot 270 which covers a corresponding region of said area 210 containing a respective predetermined fixed point of said area.

Therefore, as visible in FIG. 2D, with the task lighting system 100 according to an embodiment of the present invention, when all the lighting elements 110 are concurrently activated, a matrix of elementary light spots 270 is projected which substantially covers the entire area 210 to be illuminated. In other words, with the task lighting system 100 according to an embodiment of the present invention, the area 210 to be illuminated is subdivided in a plurality of predetermined fixed regions, each one adapted to be illuminated by a corresponding lighting element 110 with a corresponding beam light 260 projecting a corresponding elementary light spot 270 which covers said region.

In this way, after the installation of the task lighting system 100 on the extractor hood 200, a predetermined fixed mapping is established between regions of the area 210 to be illuminated and corresponding lighting elements 110.

According to an embodiment of the present invention, in order to illuminate a desired portion of the whole area 210, the control unit 115 of the task lighting system 100 is configured to activate (through the driver unit 125) the lighting elements 110 corresponding to the regions of the area 210 comprised in said desired portion. In this way, a macro light spot 280 (see FIG. 2D) corresponding to the union of the elementary light spots 270 projected by the activated lighting elements 110 is formed on said desired portion of the area 210 for the illumination thereof.

According to an embodiment of the present invention, the control unit 115 may be configured to carry out at least one among the following operations upon reception of corresponding user's commands:

- generate a macro light spot 280 for illuminating a portion of the area 210 having a desired size and position by activating the lighting elements 110 which provide elementary light spots 270 covering the regions of the area 210 corresponding to said portion of the area 210.
- increase the size of an already generated macro light spot 280 by activating new lighting elements 110 to provide new elementary light spots 270 in proximity of (e.g., around to) elementary light spots 270 of already activated lighting elements 110;
- decrease the size of an already generated macro light spot 280 by deactivating lighting elements 110 providing elementary light spots 270 forming the macro light spot 280 (e.g., at the borders thereof);
- modify the position of an already generated macro light spot 280 to illuminate a new, different portion of the area 210 by activating the lighting elements 110 which provide elementary light spots 270 covering the regions of the area 210 corresponding to said new portion of the area 210, at the same time deactivating the lighting elements 110 which provided elementary light spots 270 covering regions of the area 210 corresponding to the previously illuminated portion of the area 210 which should not be illuminated any longer;
- produce the gradual movement of a macro light spot 280 from a first position corresponding to a first portion of the area 210 to a second position corresponding to a second portion of the area 210 by sequentially deactivating lighting elements 110 which provided elementary light spots 270 covering regions of the area 210 corresponding to the first portion, at the same time sequentially activating lighting elements 110 which provide elementary light spots 270 covering regions of the area 210 corresponding to the second portion.

According to an embodiment of the present invention, the control unit 115 is further configured to set light features of light emitted by the lighting elements 110 in order to set light features of the corresponding macro light spot 280. Hereinafter, with "light features" it will be intended a set of features describing certain properties of the light emitted by the lighting elements, such as the intensity, the color, and the white color temperature, and certain properties of the light spot, such as the brightness, the color and the white color temperature.

According to an embodiment of the present invention, the driver unit 125 (see FIG. 1) is further configured to regulate the intensity of the light emitted by said lighting elements 110 individually or in groups of more than one lighting elements 110. For this purpose, according to an embodiment of the present invention, each driver of the driver unit 125 is configured to regulate the amount of electric power delivered to each lighting element 110 individually or to groups of lighting elements 110 (each one comprising more than one lighting element 110). In this way, the control unit 115 is able to set/modify the brightness of the macro light spot 280 by setting the brightness of the elementary light spots 270 forming the macro light spot 280 by regulating the electric power delivered to the corresponding lighting elements 110.

According to an embodiment of the present invention, each lighting element 110 may include a plurality of individually controllable electric light sources 240 (e.g., three LEDs) associated with one or more optical elements 245, with each individually controllable electric light source 240 that emits light of a specific color (e.g., a red LED, a green LED and a blue LED). The control unit 115 is able to set/modify the color of the elementary light spots 270 by individually setting the intensities of each controllable electric light source 240 of the corresponding lighting elements 110. In this way, the control unit 115 is able to set/modify the color of (portions of) the macro light spot 280 by individually setting/modifying the colors of the light emitted by corresponding lighting elements 110.

According to an embodiment of the present invention, each lighting element 110 may include a plurality of individually controllable white color electric light sources 240 (e.g., three white LEDs) associated with one or more optical elements 245. The control unit 115 is able to set/modify the white color temperature of the elementary light spots 270 by individually setting the intensities of each adjustable electric light source 240 of the corresponding lighting elements 110. In this way, the control unit 115 is able to set/modify the white color temperature of (portions of) the macro light spot 280 by individually setting/modifying the white color temperatures of the light emitted by corresponding lighting elements 110.

According to an embodiment of the present invention a user may interact with the task lighting system 100 by providing commands through the input interface 135 for setting or modifying the position, the size, and/or the light features of the macro light spot 280 within the area 210. In response to such commands, the control unit 115 is configured to set/modify the position, the size, and/or the light features of the macro light spot 280 by controlling selected lighting elements 110 or groups of lighting elements 110 (each one comprising more than one lighting element 100) as described above.

Different types of input interfaces 135 may be employed in the task lighting system 100.

According to an embodiment of the present invention, the input interface 135 is a button based interface, for example directly located on a panel located on the lower portion 218 of the extractor hood 200, or close to the area 210 to be illuminated (such as on the same control zone of the cooktop), comprising a set of physical buttons, touch buttons and/or touchless buttons, as well as knobs, each one operable for regulating through step-by-step discrete variations a respective one among the position along the x direction, the position along the z direction, the size, the brightness, the color, and the white color temperature of the macro light spot 280.

According to another embodiment of the present invention, the input interface 135 comprises slider based input elements, such as physical leverages, one-dimensional touch sliders, and/or one-dimensional touchless sliders, each one operable for regulating through continuous stepless variations at least a respective one among the position along the x direction, the position along the z direction, the size, the brightness, the color, and the white color temperature of the macro light spot 280.

According to still another embodiment of the present invention, the input interface 135 may include a joystick or a two-dimensional touch based slider operable for concurrently regulating through continuous stepless variations the position along the x and the z directions of the macro light spot 280.

According to still another embodiment of the present invention, the input interface 135 may be a gesture based interface, in which each type of regulation is associated with a respective hand gesture.

The input interface 135 may also include a mix of the previously described command elements.

Figure 3A:
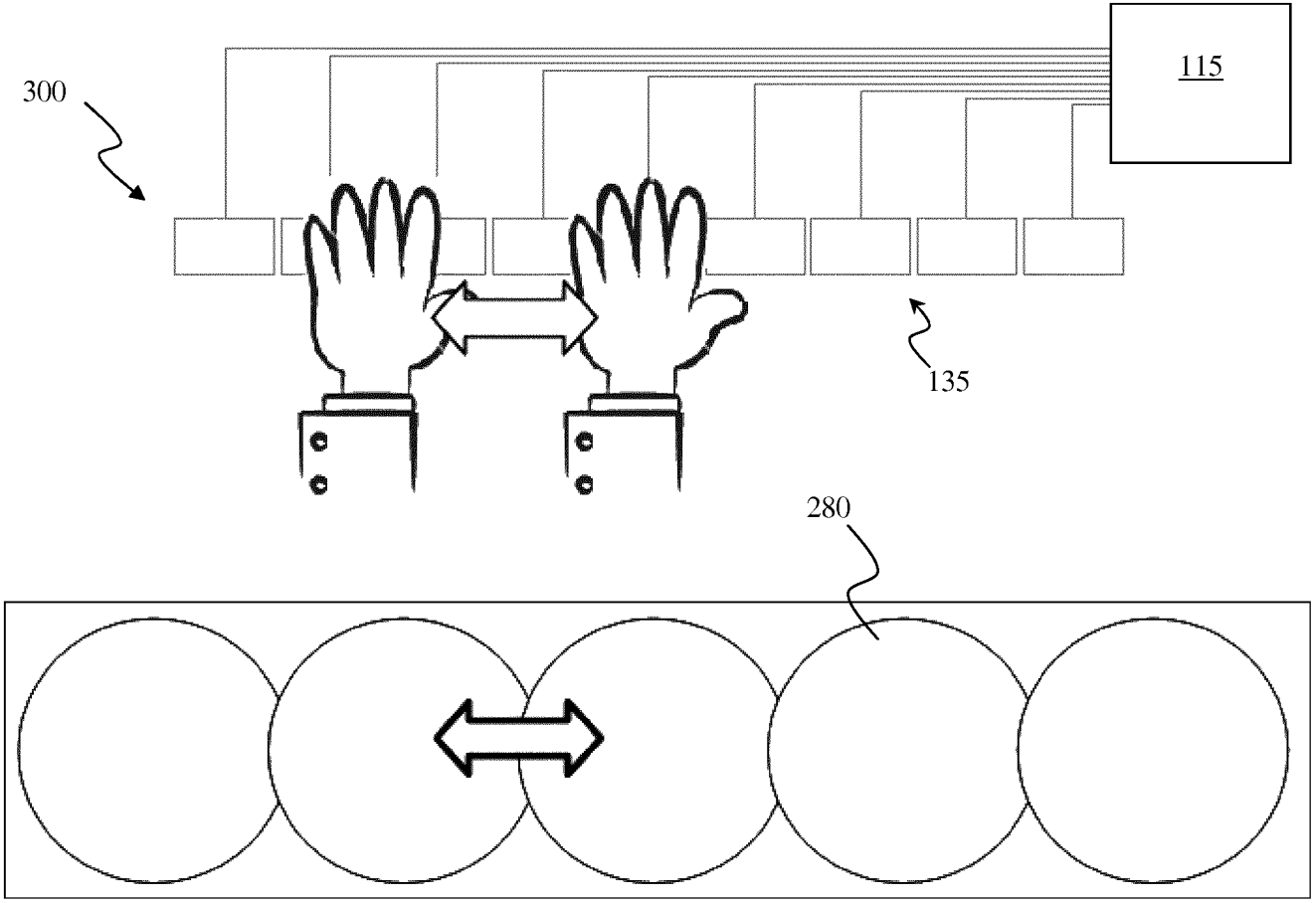
FIGS. 3A, 3B and 3C are examples illustrating possible ways of interaction with the task lighting system of FIG. 1 according to an embodiment of the present invention.
Figure 3B:
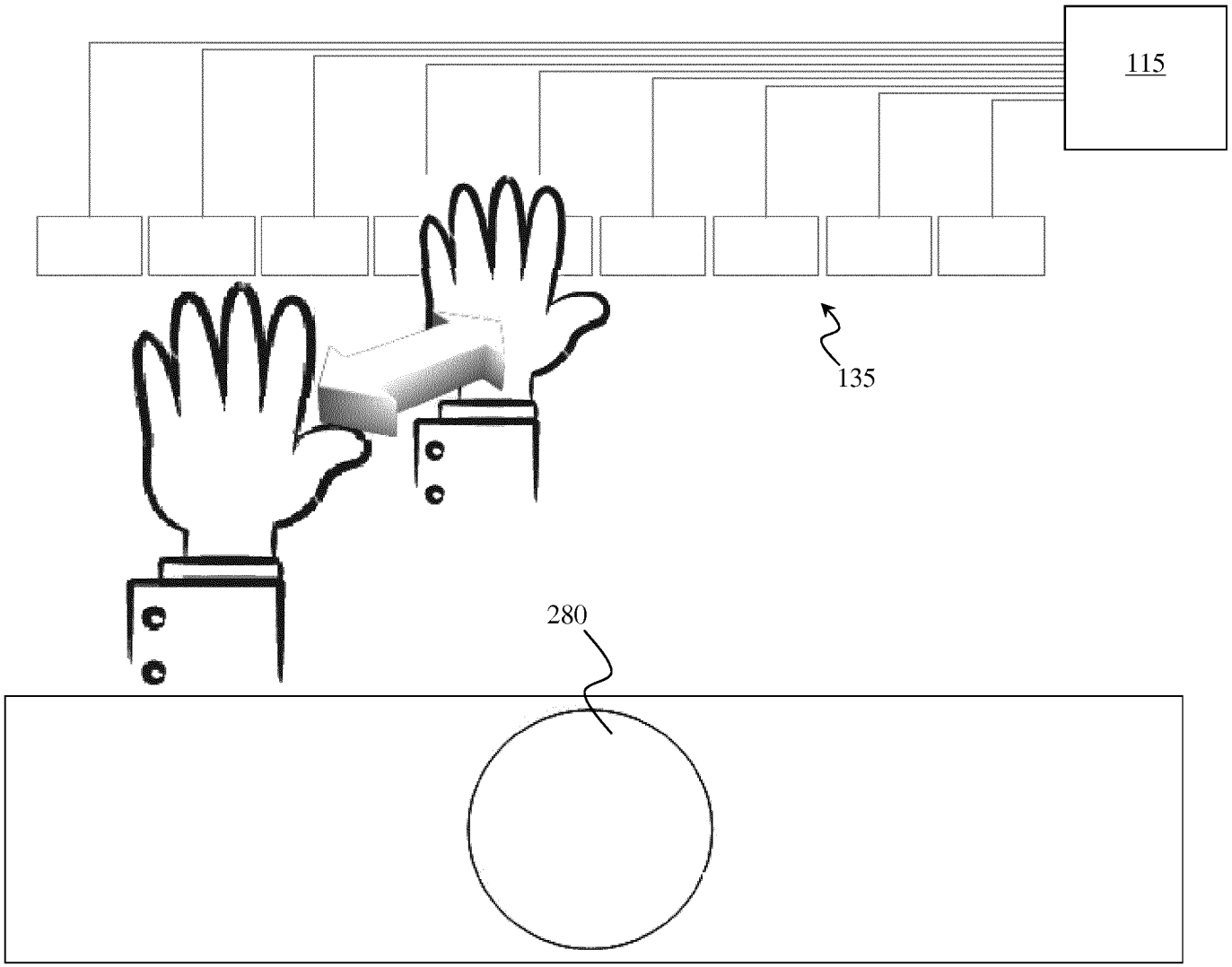
Figure 3C:
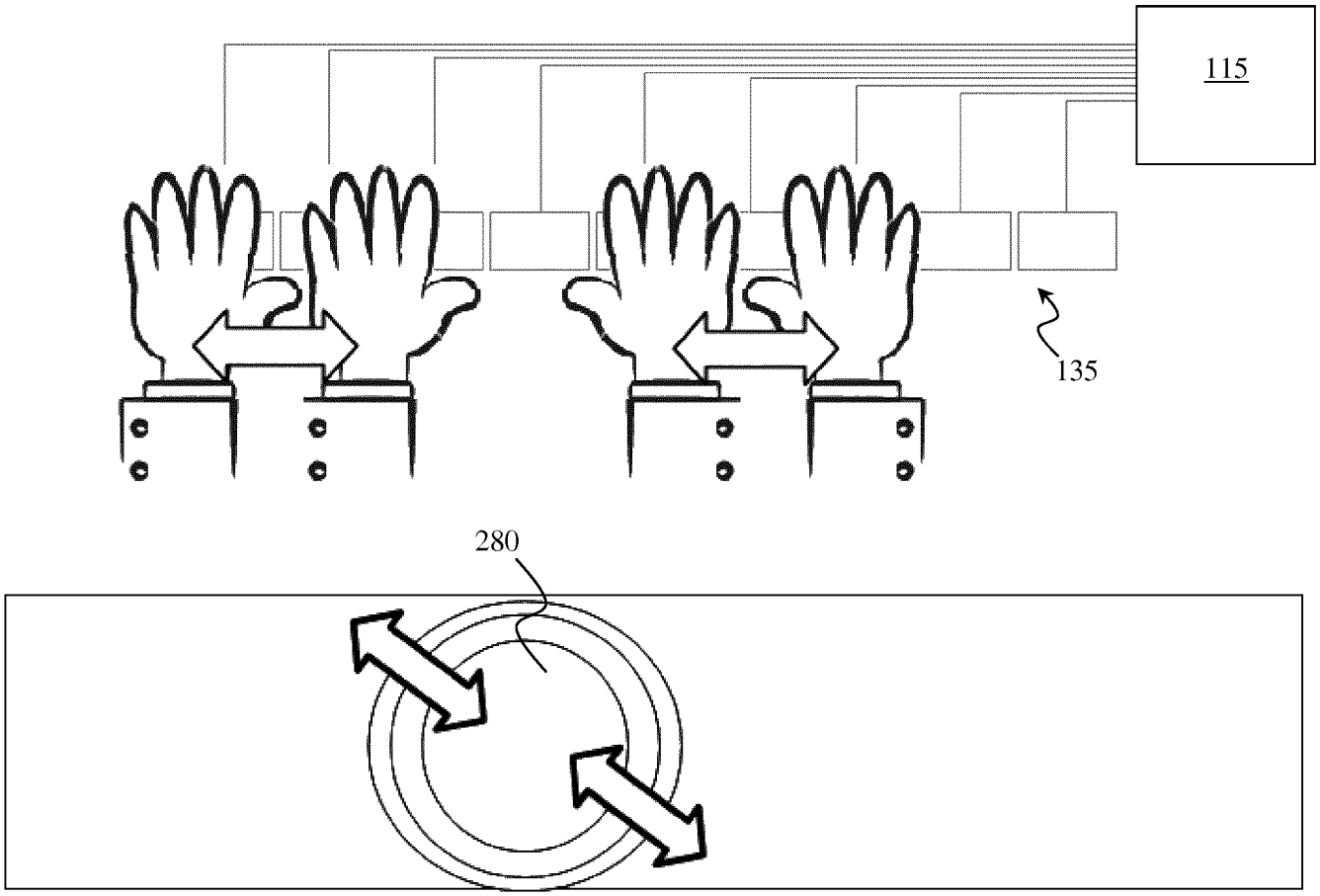

FIGS. 3A, 3B and 3C are examples illustrating possible ways of interaction with the task lighting system 100 when provided with an input interface 135 comprising a one-dimensional touchless slider, identified in the figures with reference 300. The touchless slider may comprise a plurality of basic elements calculating the distance from the hand standing or moving in front of the slider. These elements can be for example IR LEDs with IR sensors or capacitive proximity electrodes. A filtered and weighted combination of the values at the different elements, calculated by controller unit 115, will determine the current position of the hand and the distance from the slider. The temporal succession of positions allows the control unit to calculate a movement in x or z direction and then the gesture associated. Using multiple basic elements, at least 3, it is possible to perform multiple hand sensing and then more complex gesture recognition.

In the example illustrated in FIG. 3A, a user may regulate the position of the macro light spot 280 along the z direction trough left-right movements of his/her hand along the one-dimensional touchless slider 300.

In the example illustrated in FIG. 3B, a user may regulate the intensity of the macro light spot 280 based on the distance between his/her hand and the one-dimensional touchless slider 300. For example, by getting the hand closer to the one-dimensional touchless slider 300, the intensity of the macro light spot 280 is increased.

In the example illustrated in FIG. 3C, a user may regulate the size of the macro light spot 280 using a two-hand gesture. For example, by moving the two hands toward each other along the one-dimensional touchless slider 300, the size of the macro light spot 280 is reduced, and by moving the two hands away of each other along the one-dimensional touchless slider 300, the size of the macro light spot 280 is increased.

The task lighting system 100 according to the embodiments of the present inventions allows to illuminate different areas without having to move any part of the lighting system, in particular without having to mechanically move the lighting elements. Since the task lighting system 100 does not require the presence of protruding elements, it occupies a small amount of space, and is less prone to get dirty, especially if the input interface is provided with touchless sliders. Moreover, the task lighting system 100 provides users with an intuitive and natural way to control the position, size and brightness of the illuminated portion.

According to another embodiment of the present invention, the task lighting system 100 may be also provided with sensors 190 (see FIG. 1) for detecting and measuring the ambient light at the area 210 to be illuminated (for example, light and/or color sensors), or in proximity of it, and coupled with the control unit 115. According to this embodiment of the invention, the control unit 115 is configured to automatically regulate the brightness, the white color temperature and/or the color of the generated macro light spot 280 based on the ambient light measured by the sensors 190.

For example, the control unit 115 may increase the intensity of the light emitted by the lighting elements 110 proportionally to the intensity of the ambient light measured by the sensor 190.

As another example, the control unit 115 may regulate the white color temperature of the light emitted by the lighting elements 110 to a relatively low value (e.g., 2000-3000 K) when the sensor 190 detects nighttime ambient light, and to a relatively high value (e.g., 5000-6500 K) when the sensor 190 detects daytime ambient light.

As a further example, the control unit 115 may modify the blue content of the light emitted by the lighting elements 110 according to the ambient light measured by the sensor 190 to implement a blue light therapy.

Naturally, in order to satisfy local and specific requirements, a person skilled in the art may apply to the solution described above many logical and/or physical modifications and alterations.

For example, although in the present description reference has been made to a task lighting system adapted to be installed in an extractor hood of a kitchen, similar considerations apply to any application in which a task lighting is needed.

The invention claimed is:

1. A kitchen unit having a task lighting system for illuminating an operative area, the task lighting system comprising:

a plurality of fixed lighting elements configured to generate, on the operative area, corresponding fixed elementary light spots and macro light spots formed by the union of the elementary light spots; and a control unit configured to receive a spot position signal indicative of a desired position of a macro light spot and to selectively activate, based on the spot position signal, the lighting elements to generate a macro light spot with said desired position.

2. A kitchen unit according to claim 1, wherein the control unit is further configured to receive a spot shape signal indicative of a desired shape of the macro light spot and to selectively activate, based on the spot shape signal, the lighting elements to generate a macro light spot with said desired shape.

3. A kitchen unit according to claim 1, wherein the control unit is further configured to receive a spot size signal indicative of a desired size of a macro light spot and to selectively activate, based on the spot size signal, the lighting elements to generate a macro light spot with said desired size.

4. A kitchen unit according to claim 1, further comprising an input interface configured to receive commands from a user and to generate corresponding signals for the control unit including at least said spot position signal.

5. A kitchen unit according to claim 1, wherein the control unit is further configured to set light features of a macro light spot by setting light features of activated ones of said lighting elements.

6. A kitchen unit according to claim 5, wherein said light features of the macro light spot comprise at least one among brightness, color, and white color temperature and said light features of the activated lighting elements comprise at least one among intensity, color, and white color temperature.

7. A kitchen unit according to claim 1, wherein the control unit comprises a plurality of drivers configured to selectively enable/disable electric power delivery to corresponding lighting elements or groups of lighting elements to selectively activate/deactivate lighting elements or groups of lighting elements.

8. A kitchen unit according to claim 7, wherein said drivers are further configured to regulate the amount of electric power delivered to the corresponding lighting elements or groups of lighting elements to regulate the intensity of the light emitted by the lighting elements.

9. A kitchen unit according to claim 1, wherein each lighting element comprises at least an electric light source and an optical element.

10. A kitchen unit according to claim 9, wherein the electric light source comprises one or more LEDs or one or more lamps, and the optical element comprises one or more lens or mirrors.

11. A kitchen unit according to claim 1, wherein the lighting elements are arranged according to a matrix.

12. A kitchen unit according to claim 1, wherein the task lighting system comprises at least two lighting units each comprising a plurality of lighting elements, said lighting units being positioned on different parts of the kitchen unit to illuminate adjacent portions of the operative area.

13. A kitchen unit according to claim 1, wherein the kitchen unit is a kitchen air extractor hood and wherein the operative area is an area under the extractor hood.

14. A method for illuminating an operative area below a kitchen unit, the kitchen unit being provided with at least a plurality of fixed lighting elements configured to generate, on the operative area, corresponding fixed elementary light spots and macro light spots by the union of the elementary light spots, the method comprising selectively activating, based on a spot position command indicative of a desired position of a macro light spot, the lighting elements to generate a macro light spot with said desired position.

15. A method according to claim 14, further comprising selectively activating, based on a spot shape command indicative of a desired shape of a macro light spot and/or a spot size command indicative of a desired size of a macro light spot, the lighting elements to generate a macro light spot with said desired shape and/or size.

16. A kitchen unit according to claim 1, wherein each of the plurality of fixed lighting elements has a fixed position and orientation relative to the operative area.

17. A kitchen unit according to claim 1, wherein each of the plurality of fixed lighting elements, when activated, projects an elementary light spot that covers a predetermined fixed point of the operative area.

18. A kitchen unit according to claim 1, wherein when all of the plurality of fixed lighting elements are concurrently activated, a matrix of elementary light spots covers the entire operative area.

19. A kitchen unit according to claim 1, wherein the control unit is configured to set and/or modify the desired position, size, and/or light features of the macro light spots in response to user commands through an input interface.

20. A kitchen unit according to claim 1, wherein the control unit is configured to set a brightness of the macro light spots by regulating an electric power delivered to corresponding lighting elements.

21. A kitchen unit according to claim 1, wherein the macro light spots are formed by the union of overlapping elementary light spots.

* * * * *